US011663862B2

(12) United States Patent
Gustafsson et al.

(10) Patent No.: US 11,663,862 B2
(45) Date of Patent: May 30, 2023

(54) METHOD FOR DIAGNOSING A PART OF A CRANK CASE VENTILATION SYSTEM

(71) Applicant: VOLVO TRUCK CORPORATION, Gothenburg (SE)

(72) Inventors: Per Gustafsson, Kållered (SE); Milad Mousavi, Gothenburg (SE)

(73) Assignee: VOLVO TRUCK CORPORATION, Gothenburg (SE)

( * ) Notice: Subject to any disclaimer, the term of this patent is extended or adjusted under 35 U.S.C. 154(b) by 0 days.

(21) Appl. No.: 17/454,941

(22) Filed: Nov. 15, 2021

(65) Prior Publication Data

US 2022/0165105 A1 May 26, 2022

(30) Foreign Application Priority Data

Nov. 20, 2020 (EP) ..... 20208927

(51) Int. Cl.
*F01M 13/04* (2006.01)
*G07C 5/08* (2006.01)
*F01M 11/10* (2006.01)

(52) U.S. Cl.
CPC ..... *G07C 5/0808* (2013.01); *F01M 11/10* (2013.01); *F01M 13/04* (2013.01)

(58) Field of Classification Search
CPC ..... F01M 13/04; B04B 2005/125; F02D 2041/228; B01D 45/14; G07C 5/0808; B60W 20/50
USPC ..... 701/102
See application file for complete search history.

(56) References Cited

U.S. PATENT DOCUMENTS

2005/0022795 A1* 2/2005 Beyer ..... F01M 11/10 73/114.38
2011/0011380 A1 1/2011 Lagerlöf et al.
2017/0021300 A1* 1/2017 Sugio ..... F01M 11/08
2019/0162089 A1* 5/2019 Ekeroth ..... B04B 9/02

FOREIGN PATENT DOCUMENTS

DE 102012014474 A1 * 1/2014 ..... B01D 45/12
DE 102012014474 A1 1/2014
EP 3428413 A1 1/2019

OTHER PUBLICATIONS

European Search Report dated May 20, 2021 in corresponding European Patent Application No. 20208927.2, 7 pages.

* cited by examiner

*Primary Examiner* — Long T Tran
*Assistant Examiner* — James J Kim
(74) *Attorney, Agent, or Firm* — Venable LLP; Jeffri A. Kaminski

(57) ABSTRACT

A method for diagnosing a part of a crank case ventilation system of an engine operable in different engine running conditions, the system comprising an electrically driven crank case ventilation, eCCV, separator. The method comprises determining a compared power consumption of the eCCV separator by comparing a current power consumption indicative value of the eCCV separator with a reference value; determining whether or not the compared power consumption achieved as pre-set criteria; and diagnosing a fault in the system in response to determining that the compared power consumption achieves the pre-set criteria.

13 Claims, 4 Drawing Sheets

200

METHOD FOR DIAGNOSING A PART OF A CRANK CASE VENTILATION SYSTEM

TECHNICAL FIELD

The present invention relates to a method for diagnosing a part of a crank case ventilation system of an engine operable in different engine running conditions. The invention further relates to a controlling apparatus, a crank case ventilation system and a vehicle. The invention is applicable on vehicles, in particularly heavy vehicles, such as e.g. trucks. However, although the invention will mainly be described in relation to a truck, the crank case ventilation system is of course also applicable for other type of vehicles, such as cars, industrial construction machines, wheel loaders, marine applications such as boats and ships, etc. The invention is also applicable to stationary industrial engines.

BACKGROUND

An engine system of a vehicle may comprise an internal combustion engine and correlating equipment. For many years, the demands on engine systems have been steadily increasing and the engine systems are continuously developed to meet the various demands from the market. Reduction of exhaust gases, increasing engine efficiency, i.e. reduced fuel consumption, and improved operation are some of the criteria that are important aspects when choosing engine system. Furthermore, in the field of trucks, there are applicable law directives that have e.g. determined the maximum amount of exhaust gas pollution allowable. Still further, a reduction of the overall cost of the vehicle is important and since the engine system constitutes a relatively large portion of the total costs, it is natural that also the costs of engine system components are reduced and/or that the number of components in the engine system is reduced.

During operation of the internal combustion engine, a gaseous fuel is typically combusted in a combustion chamber, causing a piston to move reciprocally within a cylinder, the reciprocal motion being transferred to a rotating motion of a camshaft and subsequently to a motion of a propelling means of the vehicle. During combustion of the gaseous fuel in the combustion chamber, gases typically leak pass the piston ring arranged to seal the piston to the cylinder, and out to the crankcase of the engine. Such gases are referred to as blow-by, or blow-by gases. The blow-by gases contain impurities, e.g. oil droplets, and should preferably be cleaned before released into the atmosphere or returned to the combustion chamber. In order to clean the blow-by gases, the engine system is typically equipped with a crankcase ventilation system comprising a separator.

The separator is typically configured to clean the blow-by gases by separating oil droplets (and particles) using centrifugal forces caused by a rotating member of the separator. For example, the rotating member of the separator may be a disc at which the oil droplets (and particles) coalesce to form larger clusters which, due to the centrifugal force, move toward the outer edge of the disc where they are discharged onto the inner wall of a separator housing. The separated oil may e.g. be returned to the engine or an engine sump (oil pan of the engine), while the cleaned gases may be returned to the combustion chamber of the engine, or be released into the atmosphere.

The crankcase ventilation system may be subject to faults, and external sensors distributed in the system (e.g. pressure sensors or speed sensors) may be arranged and configured with the aim to detect such faults. However, sensors may be subject to internal failure, and/or may be installed in an incorrect manner, resulting in improper fault detection (e.g. indicating a fault in the system when there is no fault, or not detecting a fault when there in fact is a fault in the system). Thus, there is a need in the industry for an improved method for diagnosing the crank case ventilation system.

SUMMARY

It is an object of the present invention to at least partly alleviate the shortcomings discussed above in relation to known crank case ventilation systems, and to improve the operation of diagnosing a part of the crank case ventilation system.

According to at least a first aspect of the present invention, a method for diagnosing a part of a crank case ventilation system of an engine operable in different engine running conditions, the system comprising an electrically driven crank case ventilation, eCCV, separator, is provided. The method comprises:

- determining a compared power consumption of the eCCV separator by comparing a current power consumption indicative value of the eCCV separator with a reference value;
- determining whether or not the compared power consumption achieved as pre-set criteria; and
- diagnosing a fault in the system in response to determining that the compared power consumption achieves the pre-set criteria.

Hereby, a fault in a part of the crank case ventilation system can be detected, determined or diagnosed based on the power consumption of the eCCV separator. Thus, a separate sensor measuring e.g. gas flow or gas pressure within the system can be omitted, at least for the purpose of diagnosing a fault in the system.

Typically, the fault is diagnosed based on a deviation in the current power consumption and the expected, or target, power consumption for the same engine running condition.

According to at least one example embodiment, the speed of the eCCV separator is predetermined based on the engine running condition, i.e. it is fixed and set by the control unit based on the engine running condition. Thus, the speed of the eCCV separator may vary between two different engine running conditions, but is in general the same for the same engine running condition.

The engine running conditions may be referred to engine operational modes. The engine running condition is typically referring to how the engine is operated, e.g. idling or operating at full load (maximum torque/speed output). The blow-by gases from the crankcase will typically depend on the engine running condition. For example, at idling, no, or a very low amount, of blow-by gases are produced, while at full load, a relatively high amount of blow-by gases are produced. Thus, the required work, and the power consumption, of the eCCV separator in the crank case ventilation system varies depending on the engine running conditions. Thus, the power consumption, or power consumption indicative value, may be compared for different engine running conditions (e.g. idling/full load), e.g. at a predefined (constant) speed of the eCCV separator.

According to at least one example embodiment, the current power consumption indicative value is determined by monitoring the power consumption of the eCCV separator. Thus, the current power consumption indicative value may be referred to as a monitored power consumption indicative value. The monitoring of the power consumption of the eCCV separator may e.g. include monitoring the current or voltage fed to the eCCV separator. The monitoring may be performed on the eCCV directly, or on a control unit or controlling apparatus configured to control the operation of the eCCV. It should be understood that the current power consumption indicative value need not to be a single value taken at the current time, but may be taken as a time averaged value over a certain time. For example, the current power consumption indicative value is taken as a time average for the respective engine running condition. According to at least one example embodiment, the current power consumption indicative value is referred to as a first power consumption indicative value, or monitored power consumption indicative value.

According to at least one example embodiment, the current power consumption indicative value is based on a power consumption value of the eCCV separator at the current engine running condition, or is based on a difference between a power consumption value of the eCCV separator at the current engine running condition and a power consumption value of the eCCV separator at a different engine running condition.

Thus, the current power consumption indicative value may be a single value, or may be value which has been normalised based on a predetermined engine running condition (i.e. representing a difference, or delta value, as compared to the predetermined engine running condition). Hereby, various input can be used to determine the current power consumption indicative value. The current power consumption indicative value may be the value of the current power consumption in the unit J/s or W. For example, the current power consumption may be determined by multiplying the current A with the voltage V of the eCCV separator.

According to at least one example embodiment, the current power consumption indicative value is the power consumption value of the eCCV separator at the current engine running condition, and the reference value is an expected power consumption of the eCCV separator at the same engine running condition.

Hereby, a straightforward compared power consumption of the eCCV separator can be achieved. Thus, by comparing the power consumption value of the eCCV separator at the current engine running condition, i.e. the current power consumption value, typically in the unit J/s or W or kW, with a reference value of the expected power consumption of the eCCV separator at the same engine running condition (typically in the same unit of J/s or W or kW), a potential difference between the values can be determined in a straightforward manner. Such potential value difference (i.e. of the compared power consumption) may indicate that the current power consumption value deviates, or deviates by a certain predetermined amount, from the expected power consumption value, indicating a fault in the system. In more detail, by comparing the potential value difference (i.e. of the compared power consumption) with a pre-set criteria, e.g. that the absolute value of the potential value difference is larger than a threshold, a fault in the system may be diagnosed. It is preferred to use the absolute value of the compared power consumption as the potential value difference may be a negative value.

According to at least one example embodiment, the expected power consumption of the eCCV separator may be based on an earlier determined power consumption of the eCCV separator, or on an earlier "current power consumption indicative value", i.e. a power consumption indicative value determined for an earlier occurring engine running condition (for example, the same or corresponding engine running condition and/or for the same speed of the eCCV separator as for the current engine running condition, but which has occurred earlier in time, e.g. during a start up or a calibration setting of the system).

According to at least one example embodiment, the current power consumption indicative value is based on a difference between a power consumption value of the eCCV separator at the current engine running condition, and a power consumption value of the eCCV separator at a different engine running condition, wherein the reference value is based on a difference between corresponding expected power consumption of the eCCV separator.

Thus, the current power consumption indicative value may be a value which has been normalised based on a predetermined engine running condition (i.e. the different engine running condition), and the reference value may be a normalised reference value based on the same predetermined engine running condition. Hereby, differences, or delta values, are compared with each other for determining the compared power consumption. The reference value of the corresponding expected power consumption of the eCCV separator is thus a corresponding difference, or delta value, of the expected power consumptions for the corresponding engine running conditions The expected power consumption of the eCCV separator is typically the determined (e.g. calculated) or measured power consumption of the eCCV for the corresponding engine running condition, when operating the eCCV separator with no fault in the system. Such expected power consumption may be referred to as a target power consumption.

According to at least one example embodiment, the fault in the system is related to a fault in the eCCV separator and/or a fault in a gas connection to and/or from the eCCV separator.

As the power consumption of the eCCV separator is dependent on the operation of the same, typically by the parameters speed of the eCCV separator and the flow of blow-by gases handled by the eCCV separator, any fault directly linked to such parameters can be diagnosed by the present method. The gas connection from the eCCV separator may simply be an orifice or opening out from the eCCV separator to the atmosphere. A fault in such orifice or opening is typically only detected if it is at least partly blocked.

According to at least one example embodiment, the eCCV separator is configured for receiving blow-by gases from a crankcase of the engine, and configured for discharging cleaned gases back to the engine or to the atmosphere, and wherein the fault is related to a problem in receiving blow-by gases to the eCCV separator and/or discharging cleaned gases from the eCCV separator.

Such problems of the gaseous connection to and from the eCCV separator are relatively common, and are thus advantageous to include in the diagnosable faults. As stated before, as the power consumption of the eCCV separator is at least partly dependent on the flow of blow-by gases handled by the eCCV separator, a problem in receiving blow-by gases or discharging cleaned gases from the eCCV separator, will typically result in a changed power consumption, as the eCCV separator is typically operating at a set speed depending on the engine running condition. The changed power consumption may be an increased or decreased power consumption, depending on the fault.

According to at least one example embodiment, the fault is related to a broken, at least partly blocked or disconnected hose or pipe arranged to transport blow-by gases from the crankcase of the engine to the eCCV separator, and/or arranged to transport cleaned gases from the eCCV separator to the engine or to the atmosphere.

Hereby, problems related to hoses or pipes connected to the eCCV separator may be included in the diagnosable faults, as a broken, at least partly blocked or disconnected hose or pipe influence the flow of blow-by gases handled by the eCCV separator. For example, an at least partly blocked hose or pipe typically results in a throttling effect influencing the power consumption of the eCCV separator. Such blocking, or partly blocking, may e.g. be an ice plug.

Stated differently, the eCCV separator is typically arranged and configured to receive blow-by gases from a crankcase of the engine, and arranged and configured to discharge cleaned gases back to the engine (for further transport to a combustion chamber of the engine) or the atmosphere. Such configuration is typically embodied by that the a first hose or pipe is arranged between the crank case of the engine and the eCCV separator for transporting blow-by gases, and by that a second hose or pipe is arranged between the eCCV separator and the engine for transporting cleaned gases (or any line, hose, pipe or component prior to the combustion chamber for further transporting the cleaned gases to the combustion chamber), or is arranged between the eCCV separator and the atmosphere. Instead of the second hose or pipe, the latter may be accomplished by a simple orifice or opening from the eCCV separator to the atmosphere. The combustion engine may e.g. be a diesel engine or a petrol or gasoline engine.

Thus, problems related to a broken, at least partly blocked or disconnected first hose or pipe and/or second hose or pipe may be included in the diagnosable faults. Additionally or alternatively, an at least partly blocked orifice or opening from the eCCV separator to the atmosphere may be included in the diagnosable faults.

According to at least one example embodiment, the fault is related to the eCCV separator being stuck.

If the eCCV separator is stuck, the power consumption of the eCCV is affected, e.g. by a peak current or voltage followed by a low, or zero, power consumption as the eCCV is not handling any blow-by gases. The handling of blow-by gases refers here to the operation of cleaning the blow-by gases, but blow-by gases may still flow through the eCCV separator without being cleaned.

According to at least one example embodiment, the current power consumption indicative value is a feedback signal from the eCCV separator, or is provided by an electrical control unit arranged and configured to control the operation of the eCCV.

Hereby, various means of acquiring or determining the current power consumption indicative value is provided. For example, the feedback signal from the eCCV separator may comprise supplied current and voltage to the eCCV separator.

According to at least one example embodiment, the current power consumption indicative value is not based on an external sensor.

Hereby, the use of external sensors, such as e.g. flow sensor or pressure sensor, may be omitted, at least for the purpose of diagnosing a fault in the system. In other words, the current power consumption indicative value is according to one embodiment not based on input from an external sensor, such as a speed sensor or pressure sensor.

According to at least one example embodiment, the current and/or voltage of the eCCV separator is determined by an internal sensor in the eCCV separator.

According to at least a second aspect of the invention, a controlling apparatus for diagnosing a part of a crank case ventilation system of an engine operable in different engine running conditions, the crank case ventilation system comprising an electrically driven crank case ventilation, eCCV, separator, is provided. The controlling apparatus is configured to:

- determine a compared power consumption by comparing a current power consumption indicative value with a reference value;
- determine whether or not the compared power consumption achieved as pre-set criteria; and
- diagnose a fault in the system in response to determining that the compared power consumption achieves the pre-set criteria.

According to at least one example embodiment, the controlling apparatus is configured to perform the method, or at least some of the method steps, according to the first aspect of the invention.

According to at least a third aspect of the invention, a crank case ventilation system of an engine operable in different engine running conditions is provided. The system comprises an electrically driven crank case ventilation, eCCV, separator and a controlling apparatus according to the second aspect of the invention.

Effects and features of the second and third aspects of the invention are largely analogous to those described above in connection with the first aspect of the invention. Embodiments mentioned in relation to the first aspect of the invention are largely compatible with the second and third aspects of the invention, of which some are exemplified below.

According to at least one example embodiment, the crank case ventilation system further comprises a first hose or pipe arranged and configured to transport blow-by gases from a crankcase of the engine to the eCCV separator, and a second hose or pipe arranged and configured to discharge cleaned gases from the eCCV separator back to the engine or to the atmosphere, wherein the controlling apparatus is configured to detect a fault related to a broken, at least partly blocked or disconnected first hose or pipe and/or second hose or pipe.

As stated previously, the gas connection from the eCCV separator may simply be an orifice or opening out from the eCCV separator to the atmosphere. A fault in such orifice or opening is typically only detected if it is at least partly blocked.

According to at least one example embodiment, the controlling apparatus is configured to detect a fault related to the eCCV separator being stuck.

According to at a fourth aspect of the invention, a vehicle comprising a controlling apparatus according to the second aspect of the invention, or a crank case ventilation system according to the third aspect of the invention is provided.

Such vehicle may e.g. be an electric vehicle, or a hybrid vehicle.

For any one of the first, second, third and fourth aspects of the invention, the power consumption indicative value may e.g. be current and voltage based signals received from the eCCV separator, the current and voltage being used to determine the power consumption (typically by multiplying the values of current and voltage). As the power consumption of the eCCV separator may be determined based on the speed of the eCCV separator and the flow of blow-by gases handled by the separator, the power consumption indicative value may be based on a relation of the speed of the eCCV separator and the flow of blow-by gases handled by the separator. The power consumption indicative value may not solely be the parameter of speed of the eCCV separator, and not solely the parameter of flow of blow-by gases handled by, or flowing through, the eCCV separator, as any such parameter used alone would not be indicative of the power consumption of the eCCV separator.

According to a fifth aspect of the invention, a computer program comprising program code means for performing the method according the first aspect of the invention, when the program is run on a computer, is provided.

Further advantages and features of the present disclosure are disclosed and discussed in the following description and the accompanying drawings.

BRIEF DESCRIPTION OF THE DRAWINGS

The above, as well as additional objects, features and advantages of the present invention, will be better understood through the following illustrative and non-limiting detailed description of exemplary embodiments of the present invention, wherein.

DETAILED DESCRIPTION OF EXAMPLE EMBODIMENTS OF THE INVENTION

Figure 1:
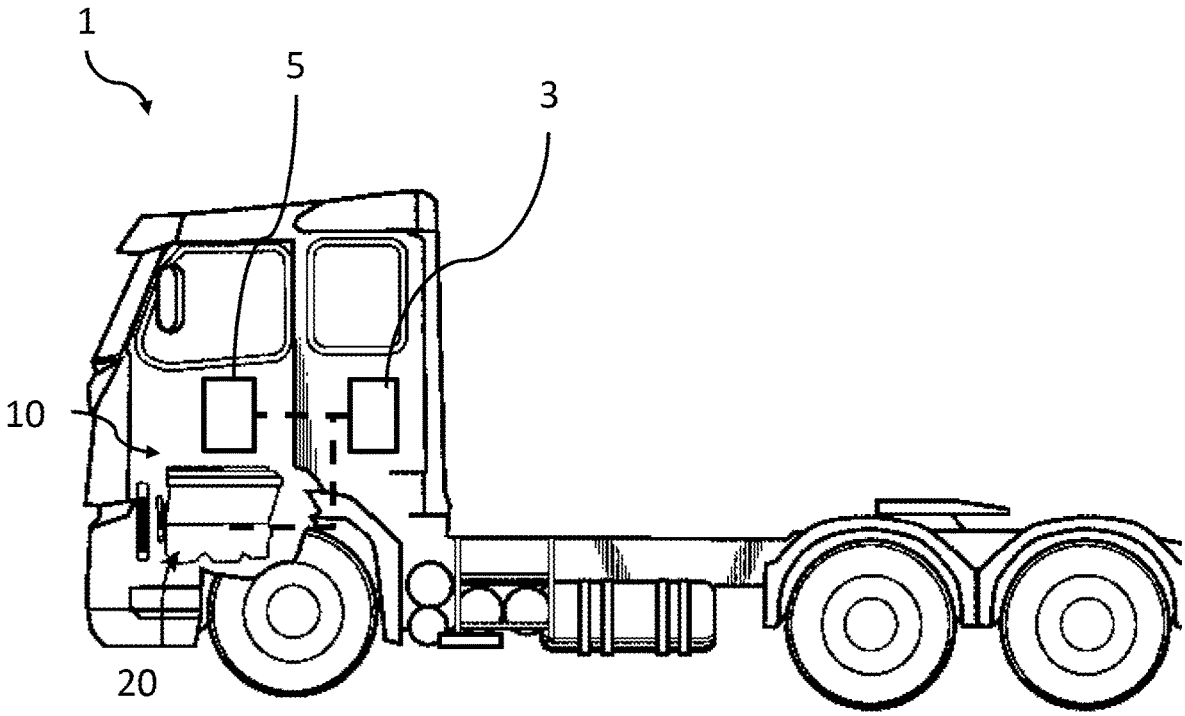
FIG. 1 is a side view of a vehicle comprising an internal combustion engine and a crankcase ventilation system according to an example embodiment of the present invention.

With reference to FIG. 1 a vehicle 1, here embodied as a heavy duty truck 1 comprising an engine 20 and a crank case ventilation system 10 having a crank case ventilation separator 5 and controlling apparatus 3, is disclosed for which the crank case ventilation system 10 of a kind disclosed in the present disclosure is advantageous. However, the crank case ventilation system 10, i.e. at least the crank case ventilation separator 5 and the controlling apparatus 3, may as well be implemented in other types of vehicles, such as in busses, light-weight trucks, passenger cars, marine applications etc. The vehicle 1 of FIG. 1 may be a hybrid vehicle comprising an engine 20, being e.g. a diesel engine 20, and an electric machine. The diesel engine 20 is powered by diesel fuel, typically comprised in a fuel tank (not shown) and the electric machine is powered by electricity supplied from at least one energy storage or transformation device, e.g. a battery or a fuel cell.

Figure 2:
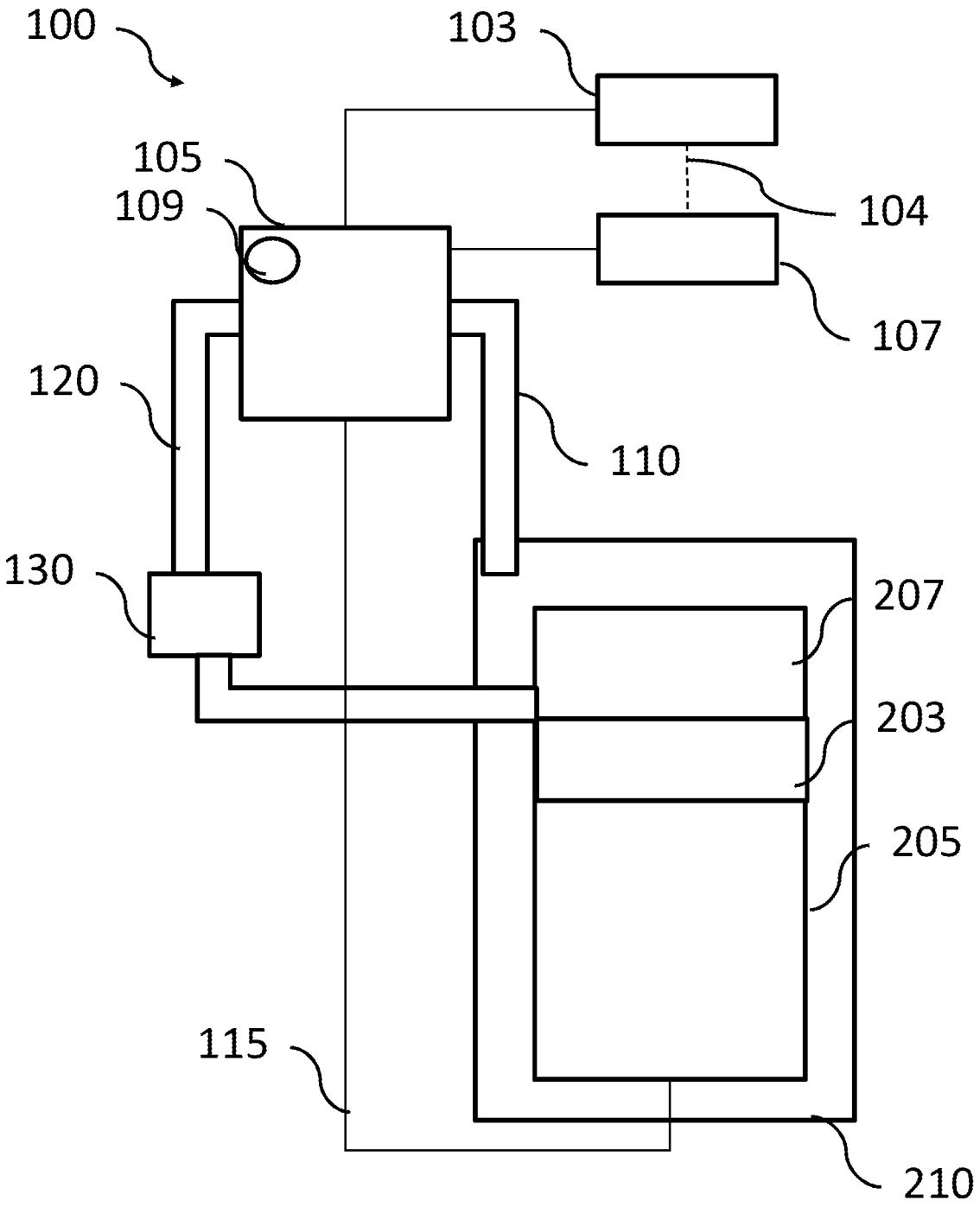
FIG. 2 is a schematic view of a combustion engine and crankcase ventilation system according to an example embodiment of the present invention.

Turning to FIG. 2, which illustrate a crank case ventilation system 100 of an engine 200 operable in different engine running conditions according to an example embodiment of the present invention. The crank case ventilation system 100 may e.g. form the crank case ventilation system 10 shown in FIG. 1. The engine 200 of FIG. 2 is greatly simplified, and only the components of interest for the crank case ventilation system 100 are shown, i.e. a piston 203 reciprocally arranged inside a cylinder 205 to form a combustion chamber 207 in which gaseous fuel is combusted. The engine 200 further comprises a crankcase 210 housing the components of the engine 200. The different engine running conditions comprises e.g. idling and full-load operation of the engine 200.

The crank case ventilation system 100 comprises an electric driven crank case ventilation separator 105, hereinafter abbreviated eCCV separator 105, a controlling apparatus 103 configured to control the operation of the eCCV separator 105, and a battery or other electricity source 107 for powering the eCCV separator 105. The eCCV separator 105 is arranged and configured to clean blow-by gases from the crankcase 210 of the engine 200. In more detail, blow-by gases are gases derived from the combustion chamber 207, which gases have leaked and passed the piston 203 and piston rings out to the crankcase 210. The blow-by gases are cleaned in the eCCV separator 105, typically by removing particles and oil droplet by centrifugal forces imposed by a separator member rotating with a certain speed (rpm). The removed particles and oil droplets may be returned to the engine 200 by a return line 115. The eCCV separator 105 is driven by electricity from the electricity source 107, and the power consumption of the eCCV separator 105 depends mainly on the combination of separation capacity (related to e.g. the speed of the separator, or rotatable separator member) and the amount of blow-by gases handled (related to e.g. the flow of blow-by gases through the eCCV separator 105). The power consumption of the eCCV separator 105 may be controlled and monitored by the controlling apparatus 103, e.g. by communication line 104. Alternatively, the power consumption of the eCCV separator 105 may be provided as a feedback signal from the eCCV separator 105. It should be noted that the controlling apparatus 103 may be, or be comprised in, an electrical control unit of the vehicle, and thus the power consumption of the eCCV separator 105 may considered to be provided by the electrical control unit 103 arranged and configured to control the operation of the eCCV separator 105.

The crank case ventilation system 100 comprises a first hose 110 for transporting blow-by gases from the crankcase 210 to the eCCV separator 105, and a second hose 120 for transporting clean gases from the eCCV separator 105 back to the engine 200, and the combustion chamber 207. Thus, the eCCV separator 105 is configured to receive blow-by gases from the crankcase 210 via the first hose 110, and is configured to discharge cleaned gases back to the engine 200 via the second hose 120. It should be noted that the first hose 110 and/or the second hose 120 may instead of hoses be pipes or any other line for transporting gases, such as channels. For example, the eCCV separator 105 may be arranged on the crankcase 210, and blow-by gases may be transported from the crankcase 210 to the eCCV separator 105 simply by channel or an opening or orifice in the crankcase 210. As indicated in FIG. 2, the second hose 120 may transport the cleaned gases to an intermediate component 130, e.g. being part of the air intake to the engine 200. As an alternative, instead of transporting blow-by gases back to the engine 200, the second hose 120 may simply release the cleaned gases to the atmosphere. As a further alternative, instead of using the second hose 120 to release the cleaned gases to the atmosphere, the eCCV separator 105 may simply comprise an orifice or opening 109 releasing the cleaned gases to the atmosphere.

Figure 3:
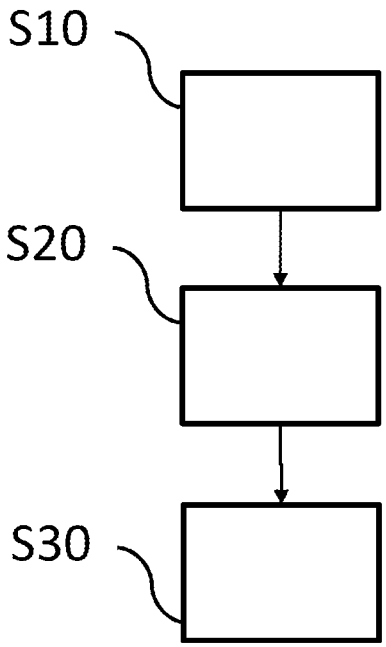
FIG. 3 is a flow chart describing various steps of a method according to example embodiments of the invention.

A method of diagnosing at least a part of the crank case ventilation system 100 will now be described with reference to the flow chart in FIG. 3, with additional reference to the crank case ventilation system 100 and engine 200 of FIG. 2.

In a step S10, being e.g. a first step S10, a compared power consumption of the eCCV separator 105 is determined by comparing a current power consumption indicative value of the eCCV separator 105 with a reference value.

In FIG. 2, the current power consumption indicative value is typically determined by monitoring the power consumption of the eCCV separator 105 by the controlling apparatus 103, and potentially the communication line 104 to the electricity source 107. Thus, the current power consumption indicative value may be referred to as a monitored power consumption indicative value, or monitored current power consumption indicative value. A power consumption indicative value may e.g. be current and voltage based signals received from the eCCV separator 105 or electricity source 107, the current and voltage being used to determine the power consumption.

In a step S20, being e.g. a second step S20, it is determined whether or not the compared power consumption achieved as pre-set criteria.

For example, the pre-set criteria is based on a relation between the compared power consumption and a threshold value, e.g. that the compared power consumption is lower than a threshold value.

In a step S30, being e.g. a third step S30, a fault in the system is diagnosed in response to determining that the compared power consumption achieves the pre-set criteria.

That is, according to the example of relating the compared power consumption with a threshold value, if the compared power consumption is lower than the threshold value, a fault is diagnosed.

The steps of the method described with reference to the flow chart of FIG. 3 may e.g. be included in the controlling apparatus 103 of the system 100 of FIG. 2. Thus, the controlling apparatus 103 is configured to: determine a compared power consumption by comparing a current power consumption indicative value (as e.g. a current power consumption in the unit J/s or W) with a reference value, corresponding to the S10; determine whether or not the compared power consumption achieved as pre-set criteria, corresponding to the step S20; and diagnose a fault in the system in response to determining that the compared power consumption achieves the pre-set criteria, corresponding to the step S30.

Figure 4A:
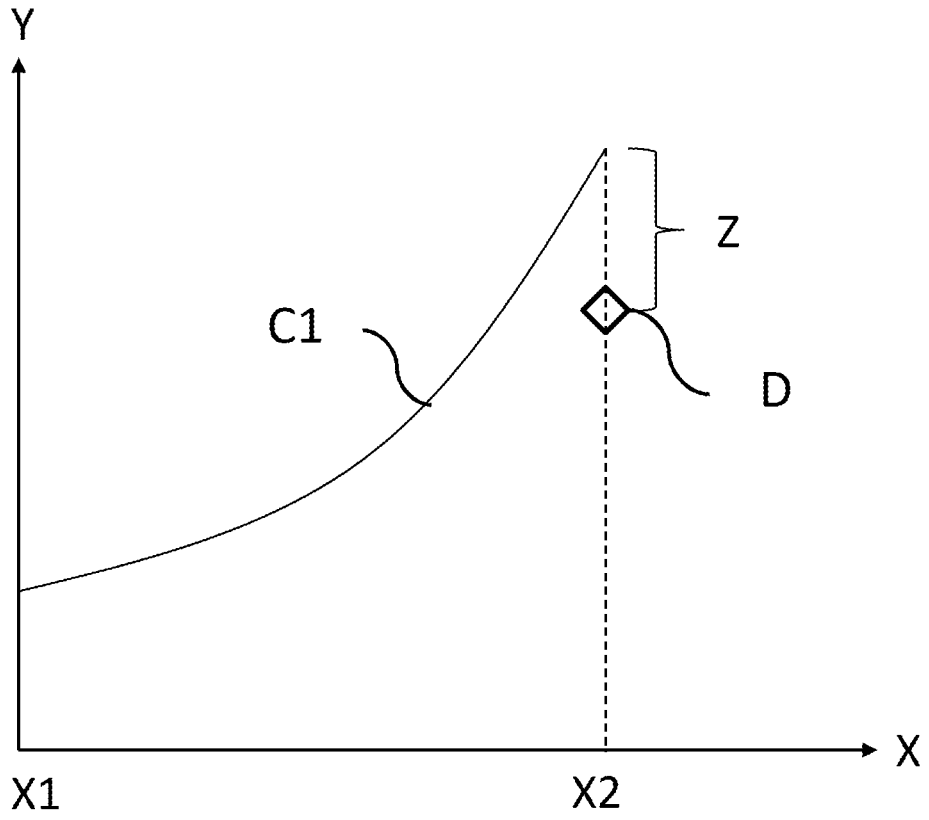
FIGS. 4A-4B are graphs schematically relating the power consumption of the eCCV separator with the engine running condition.

Turning to FIG. 4A showing a graph schematically relating the power consumption of the eCCV separator 105 on the Y-axis with the engine running condition on the X-axis. The curve C1 represents a function of how the power consumption relates to the engine running condition in a ramping from idling, X1, to full load, X2, in a crank case ventilation system 100 operating with no faults. That is, the curve C1 may be referred to as a reference curve C1 comprised of a plurality of reference values, each reference value representing the case ventilation system 100 operating with no faults at an associated engine running condition. Moreover, in FIG. 4A a monitored value of the current power consumption of the eCCV separator 105 is marked with a diamond D. That is, D represents the current power consumption determined by e.g. a current power consumption indicative value, such as the current and voltage of the eCCV separator 105. As seen in FIG. 4A, the current power consumption D is for an operation of the engine 200 in full load, i.e. for engine running condition X2, and differs from the reference value determined by the reference curve C1 at the same engine running condition X2, by a difference Z. Thus, by relating the value difference Z with what is acceptable for the system 100 and current engine running condition, e.g. taking into account tolerances and measurement errors, a fault in the system 100 can be diagnosed. For example, by applying the pre-set criteria of comparing if the value difference Z is larger than a threshold value Z1, a fault in the system 100 can be determined if the value difference Z is larger than the threshold value Z1. The threshold value Z1 is typically related to the specific system 100 and eCCV separator 105, as well as the current engine running condition.

It should be noted, that the monitored value of the current power consumption D may be based on a power consumption indicative value, the power consumption indicative value may have a unit different to the unit of power consumption (J/s, W), but still representing the power consumption of the eCCV separator 105. In such case, the reference curve C1 is comprised of reference values in corresponding unit.

In FIG. 4A, the current power consumption D is based on a power consumption value, typically in the unit J/s or W, of the eCCV separator 105 at the current engine running condition X2, and the reference value (comprised in the reference curve C1) is based on a power consumption value, typically in the unit J/s or W, being an expected power consumption of the eCCV separator at the same engine running condition X2, with no faults in the system 100. For example, the reference curve C1 may be made during a start-up of the system 100, subsequent to a fault check verifying that the system 100 is operating with no faults.

Figure 4B:
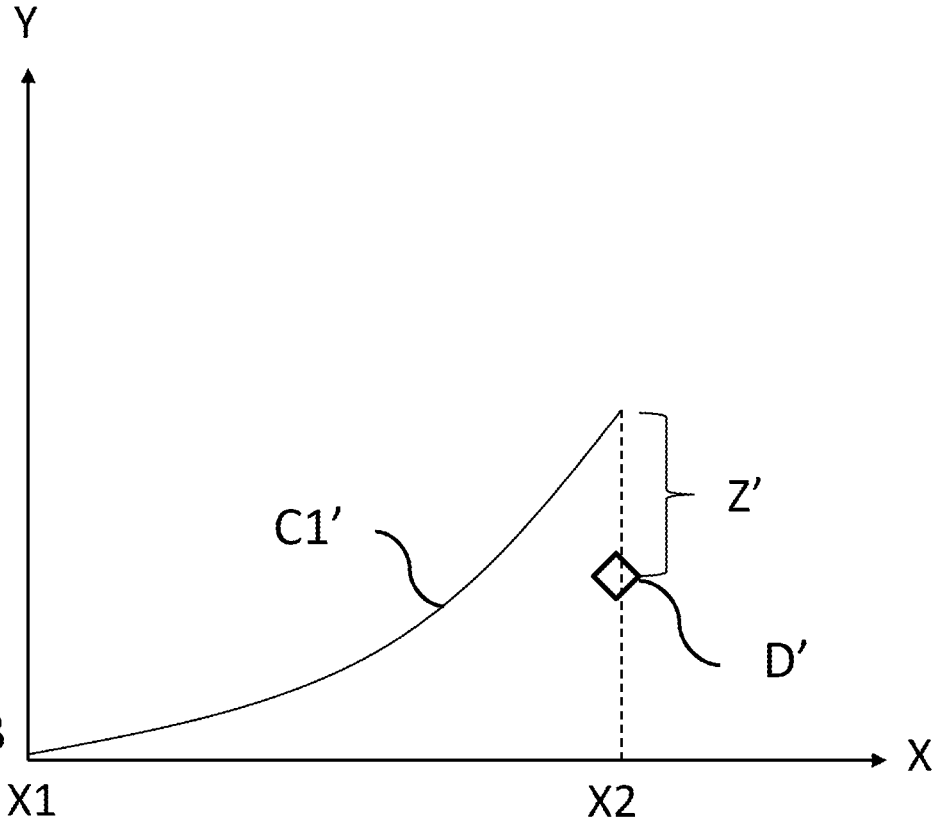

As an alternative to the criteria described with reference to FIG. 4A, the current power consumption may be based on a difference between a power consumption value of the eCCV separator 105 at the current engine running condition X2 and a power consumption value of the eCCV separator at a different engine running condition, e.g. idling X1, as shown by the marker diamond D' in the graph of FIG. 4B. Correspondingly, the reference value, or reference curve, may be based on a difference between corresponding expected power consumption of the eCCV separator 105. Thus, a normalized reference curve C1' may be used to for the compared power consumption of the eCCV separator 105, as can be shown in the graph of FIG. 4B. In other word, the normalized reference curve C1' in FIG. 4B has been normalized with regards to the engine running condition of idling X1. Thus, a corresponding value difference Z' and applicable pre-set criteria may be established as described for FIG. 4A.

As the power consumption of the eCCV separator 105 depends mainly on the combination of separation capacity (related to e.g. the speed of the separator, or rotatable separator member) and the amount of handled blow-by gases (related to e.g. the flow of blow-by gases through the eCCV separator 105), fault in the system relating to a reduction in the flow of gases through the eCCV separator 105 may be diagnosed by the present method. For example, turning back to FIG. 2, the fault in the system 100 may be related to a fault in the eCCV separator 105 itself, e.g. a stuck separator or stuck separator member, resulting a loss of separation capacity. The fault may alternatively be related to a fault in the gas connection to and/or from the eCCV separator, as e.g. related to a problem in receiving blow-by gases to the eCCV separator 105 and/or discharging cleaned gases from the eCCV separator 105. In more detail, the fault may be related to a fault in the first hose 110, e.g. a broken, blocked or at least partly blocked or disconnected first hose 110, or a fault related to a fault in the second hose 120 e.g. a broken, blocked or at least partly blocked or disconnected second hose 120. As a further alternative, the fault may be related to a block, or at least partly blocked, orifice or opening 109 arranged and configured to release the cleaned gases to the atmosphere.

It is to be understood that the present invention is not limited to the embodiments described above and illustrated in the drawings; rather, the skilled person will recognize that many changes and modifications may be made within the scope of the appended claims. In particular, it should be understood that the crank case ventilation system 100 of FIG. 2 is schematic, and comprises the components emphasised in this disclosure. Other components, e.g. valves, throttles, pumps and compressors are typically included in the system 100 in positions known to the skilled person.

Additionally, variations to the disclosed embodiments can be understood and effected by the skilled person in practicing the claimed inventive concept, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. A method for diagnosing a part of a crank case ventilation system of an engine operable in different engine running conditions, the system comprising an electrically driven crank case ventilation (eCCV) separator, configured for receiving blow-by gases from a crankcase of the engine, and configured for discharging cleaned gases back to the engine or to the atmosphere, the method comprising:

determining a compared power consumption of the eCCV separator by comparing a current power consumption indicative value of the eCCV separator with a reference value; wherein the current power consumption indicative value is based on a power consumption value of the eCCV separator at the current engine running condition, or is based on a difference between a power consumption value of the eCCV separator at the current engine running condition and a power consumption value of the eCCV separator at a different engine running condition;

determining whether or not the compared power consumption achieves a pre-set criteria; and diagnosing a fault in the system related to a problem in receiving blow-by gases to the eCCV separator and/or discharging cleaned gases from the eCCV separator, in response to determining that the compared power consumption achieves the pre-set criteria.

2. The method according to claim 1, wherein the current power consumption indicative value is the power consumption value of the eCCV separator at the current engine running condition, and the reference value is an expected power consumption of the eCCV separator at the same engine running condition.

3. The method according to claim 1, wherein the current power consumption indicative value is based on a difference between a power consumption value of the eCCV separator at the current engine running condition and a power consumption value of the eCCV separator at a different engine running condition, and wherein the reference value is based on a difference between corresponding expected power consumption of the eCCV separator.

4. The method according to claim 1, wherein the fault in the system is related to a fault in the eCCV separator and/or a fault in a gas connection to and/or from the eCCV separator.

5. The method according to claim 1, wherein the fault is related to a broken, at least partly blocked or disconnected hose or pipe arranged to transport blow-by gases from the crankcase of the engine to the eCCV separator, and/or arranged to transport cleaned gases from the eCCV separator to the engine or to the atmosphere.

6. The method according to claim 1, wherein the fault is related to the eCCV separator being stuck.

7. The method according to claim 1, wherein the current power consumption indicative value is a feedback signal from the eCCV separator, or is provided by an electrical control unit arranged and configured to control the operation of the eCCV.

8. The method according to claim 1, wherein the current power consumption indicative value is not based on an external sensor.

9. A controlling apparatus for diagnosing a part of a crank case ventilation system of an engine operable in different engine running conditions, the crank case ventilation system comprising an electrically driven crank case ventilation (eCCV) separator, configured for receiving blow-by gases from a crankcase of the engine, and configured for discharging cleaned gases back to the engine or to the atmosphere, the controlling apparatus being configured to:

determine a compared power consumption by comparing a current power consumption indicative value with a reference value, wherein the current power consumption indicative value is based on a power consumption value of the eCCV separator at the current engine running condition, or is based on a difference between a power consumption value of the eCCV separator at the current engine running condition and a power consumption value of the eCCV separator at a different engine running condition;

determine whether or not the compared power consumption achieves a pre-set criteria; and diagnose a fault in the system related to a problem in receiving blow-by gases to the eCCV separator and/or discharging cleaned gases from the eCCV separator in response to determining that the compared power consumption achieves the pre-set criteria.

10. A crank case ventilation system of an engine operable in different engine running conditions, the system comprising an electrically driven crank case ventilation, eCCV, separator and a controlling apparatus according to claim 9.

11. The crank case ventilation system according to claim 10, further comprising a first hose or pipe arranged and configured to transport blow-by gases from a crankcase of the engine to the eCCV separator, and a second hose or pipe arranged and configured to discharge cleaned gases from the eCCV separator back to the engine or to the atmosphere, wherein the controlling apparatus is configured to detect a fault related to a broken, at least partly blocked or disconnected first hose or pipe and/or second hose or pipe.

12. The crank case ventilation system according to claim 10, wherein the controlling apparatus is configured to detect a fault related to the eCCV separator being stuck.

13. A vehicle comprising a controlling apparatus according to claim 9.

* * * * *